US009918900B2

(12) United States Patent
Hansen

(10) Patent No.: US 9,918,900 B2
(45) Date of Patent: Mar. 20, 2018

(54) INVERSE BLOW-FILL-SEAL PACKAGING

(71) Applicant: R.P. Scherer Technologies, LLC, Las Vegas, NV (US)

(72) Inventor: Timothy S. Hansen, Woodstock, IL (US)

(73) Assignee: R.P. SCHERER TECHNOLOGIES, LLC, Las Vegas, NV (US)

( * ) Notice: Subject to any disclaimer, the term of this patent is extended or adjusted under 35 U.S.C. 154(b) by 13 days.

(21) Appl. No.: 14/883,868

(22) Filed: Oct. 15, 2015

(65) Prior Publication Data

US 2016/0120749 A1 May 5, 2016

Related U.S. Application Data

(60) Provisional application No. 62/069,968, filed on Oct. 29, 2014.

(51) Int. Cl.
*B65D 1/06* (2006.01)
*A61J 1/06* (2006.01)
(Continued)

(52) U.S. Cl.
CPC ..... *A61J 1/067* (2013.01); *B65B 3/003* (2013.01); *B65B 3/022* (2013.01); *B65B 61/20* (2013.01);
(Continued)

(58) Field of Classification Search
None
See application file for complete search history.

(56) References Cited

U.S. PATENT DOCUMENTS 3,993,223 A * 11/1976 Welker, III ..... B65D 1/095 206/528
4,495,209 A 2/1985 Whiteside
(Continued)

FOREIGN PATENT DOCUMENTS

EP 2066570 B1 1/2011
EP 1833462 B1 4/2013
(Continued)

OTHER PUBLICATIONS

International Search Report and Written Opinion; dated Jan. 16, 2016 for PCT Application No. PCT/US2015/055671.

*Primary Examiner* — Monica Huson
(74) *Attorney, Agent, or Firm* — Mendelsohn Duneleavy, P.C.

(57) ABSTRACT

A method for blow-fill-seal (BFS) packaging of a product and a BFS package. The method forms a BFS package with a twist-off top, container body and information panel in a main mold. The container is filled via a fill opening located distal to the twist-off top and the fill opening is sealed with a base portion. This provides a container having a twist-off top that is more reliably secured to the container body. A plurality of containers may be attached to a single information panel. The BFS packaging system may employ a quick change insert to reduce lost production time when changing products or lots. The package includes an information panel integrally formed with a plurality of twist-off tops, each of which is removably attached to a container body whereby each container body can be removed from the package without removing the remaining container bodies from the information panel.

8 Claims, 7 Drawing Sheets

(51) Int. Cl.

| | |
|---|---|
| ***B65D 1/09*** | (2006.01) |
| ***B65D 1/02*** | (2006.01) |
| ***B65D 1/08*** | (2006.01) |
| ***B65B 3/02*** | (2006.01) |
| ***B65B 61/20*** | (2006.01) |
| ***B65D 1/32*** | (2006.01) |
| ***B65B 3/00*** | (2006.01) |

(52) U.S. Cl.
CPC ..... *B65D 1/0238* (2013.01); *B65D 1/08* (2013.01); *B65D 1/095* (2013.01); *B65D 1/32* (2013.01); *A61J 2205/30* (2013.01)

(56) References Cited

U.S. PATENT DOCUMENTS

| | | | | |
|---|---|---|---|---|
| 4,707,966 | A * | 11/1987 | Weiler | B29C 66/542 264/524 |
| 6,418,982 | B1 | 7/2002 | Zhang et al. | |
| 7,487,894 | B2 | 2/2009 | Zahn et al. | |
| 8,377,029 | B2 | 2/2013 | Nagao et al. | |
| 8,381,774 | B2 | 2/2013 | Mitchell et al. | |
| 8,486,043 | B2 | 7/2013 | Iyer et al. | |
| 8,663,188 | B2 | 3/2014 | Genosar et al. | |
| 2002/0134374 | A1 * | 9/2002 | Loeffler | A61J 1/065 128/200.14 |
| 2006/0169664 | A1 | 9/2006 | Miller et al. | |

FOREIGN PATENT DOCUMENTS

| | | | |
|---|---|---|---|
| WO | WO9943549 | A1 | 9/1999 |
| WO | WO2009101489 | A1 | 8/2009 |

* cited by examiner

INVERSE BLOW-FILL-SEAL PACKAGING

RELATED APPLICATION DATA

This application claims priority to U.S. Provisional Application No. 62/069,968, filed Oct. 29, 2014, the entire disclosure of which is hereby incorporated by reference as if set forth fully herein.

BACKGROUND OF THE INVENTION

1. Field of the Invention

The present invention is directed to the field of packaging products. In particular the invention is directed to blow-fill-seal package and an inverse blow-fill-seal container.

2. Description of the Related Technology

Blow-fill-seal (BFS) packaging is a process wherein extruded resin, such as polyethylene (PE) or polypropylene (PP), is blown in a sterile and pyrogen-free state into a mold shaped in the desired form of a container. Following the formation of a container, the container cools and is then filled with product and sealed.

Traditional BFS containers have been designed to be molded and filled from the top of the container. After filling the containers from the top, a twist-off portion of the container is formed by a sealing mold. When filling containers made by this process some problems are encountered. The complex geometry of the twist-off tip presents significant challenges for maintaining the integrity of the twist-off tip of the container. This can result in less than optimal sealing at the twist-off tip. Therefore there is a need to develop BFS containers having twist-off tips that are able to effectively and consistently retain the integrity of the twist-off tip of the container.

SUMMARY OF THE INVENTION

The present invention is directed to a method and system for blow-fill-seal packaging.

An aspect of the present invention may be a method of forming BFS packaging comprising: (a) molding a container body and twist-off top, wherein the twist-off top is integrally formed with an information panel; (b) filling the container body; and (c) sealing the container body to a base portion.

Another aspect of the present invention may be a BFS package comprising: a plurality of container bodies comprising twist-off tops, wherein the twist-off tops are integrally formed with an information panel; and a plurality of base portions are sealed to the container bodies.

The inverse blow-fill-seal packaging of the present invention permits filling and sealing of the package via a fill opening that is not at the same location as the twist-off top in order to facilitated sealing the package after filling without interfering with the frangible connection between the container body and the twist-off top.

DETAILED DESCRIPTION OF THE PREFERRED EMBODIMENT(S)

For illustrative purposes, the principles of the present disclosure are described by referencing various exemplary embodiments. Although certain embodiments are specifically described herein, one of ordinary skill in the art will readily recognize that the same principles are equally applicable to, and can be employed in other systems and methods.

Before explaining the disclosed embodiments of the present disclosure in detail, it is to be understood that the disclosure is not limited in its application to the details of any particular embodiment shown. Additionally, the terminology used herein is for the purpose of description and not of limitation. Furthermore, although certain methods are described with reference to steps that are presented herein in a certain order, in many instances, these steps may be performed in any order as may be appreciated by one skilled in the art; the novel methods are therefore not limited to the particular arrangement of steps disclosed herein.

It must be noted that as used herein and in the appended claims, the singular forms "a", "an", and "the" include plural references unless the context clearly dictates otherwise. Furthermore, the terms "a" (or "an"), "one or more" and "at least one" can be used interchangeably herein. The terms "comprising", "including", "having" and "constructed from" can also be used interchangeably.

In order to address some of the problems that may be encountered using a typical BFS container design, the BFS container is filled from the bottom of the container body. This configuration causes the more complex geometry of the twist-off top to be formed in the main mold and in so doing it also allows a larger opening for a container fill tube. For example, a standard neck opening may be about 0.477 cm, while an inverse fill neck opening in the bottom of the container body as in the present invention may be about 0.635 cm. By providing an inverse fill neck opening in the bottom of the container body, the opening for the container fill tube may be increased between up to 50% or more in some instances. This also creates a more robust sealing interface between the main mold and sealing mold thereby reducing the risk of the container leaking.

Figure 1A:
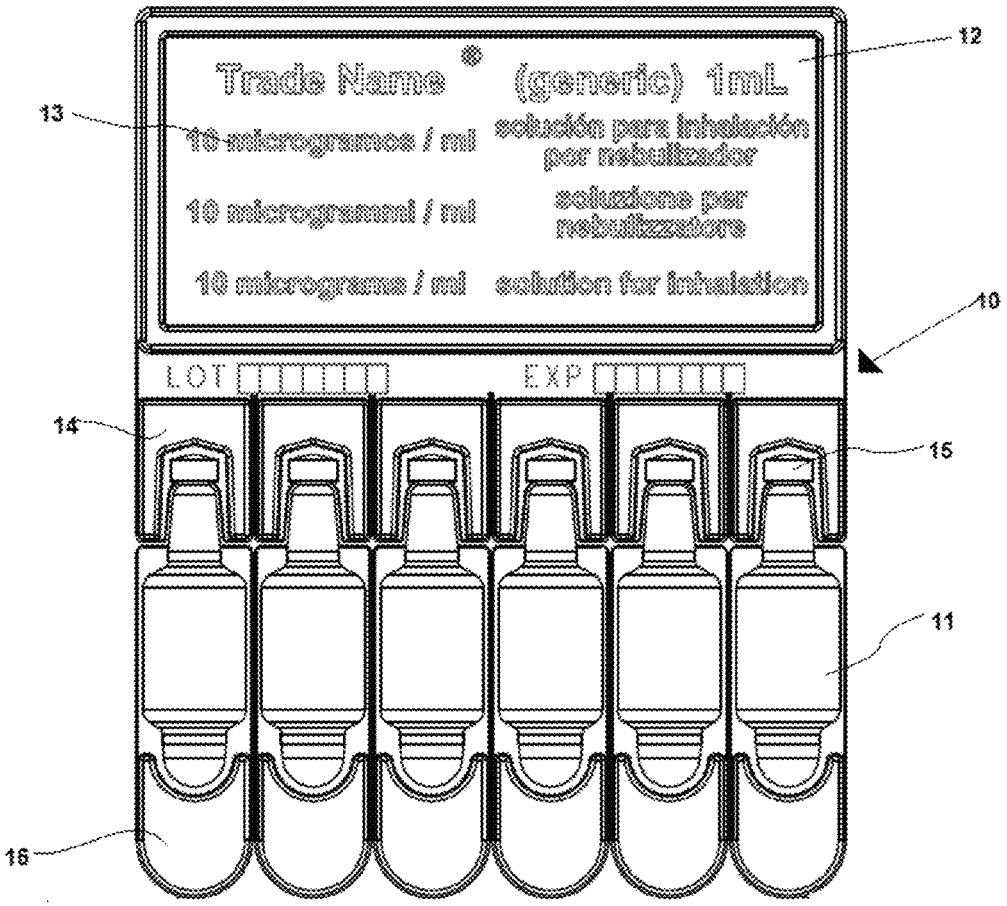
FIG. 1A shows a front view of a BFS package in accordance with an embodiment of the present invention.
Figure 1B:
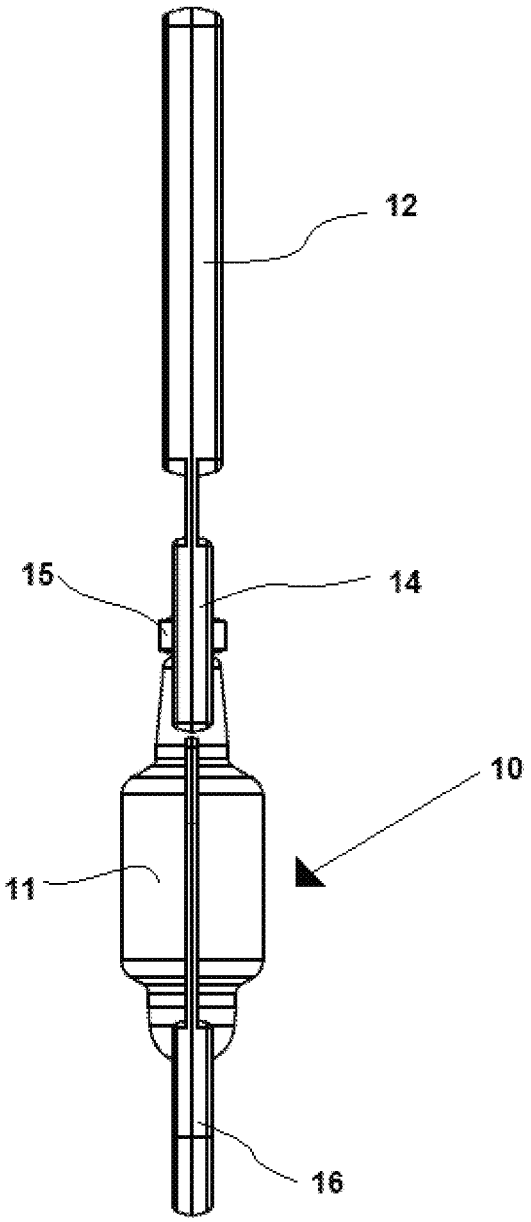
FIG. 1B shows a side view of the BFS package shown in FIG. 1A.
Figure 1C:
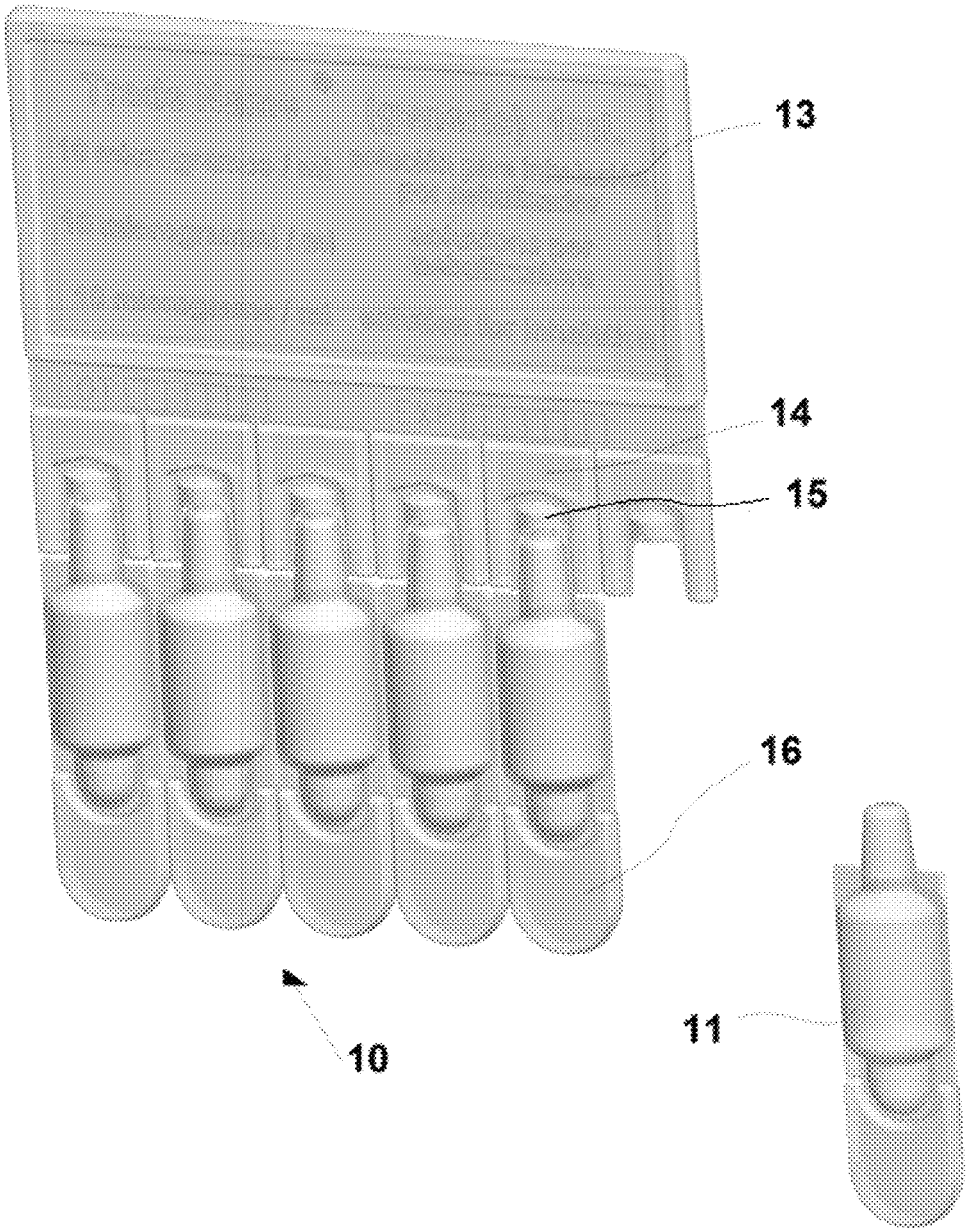
FIG. 1C shows a perspective view of the BFS package shown in FIGS. 1A and 1B with a container removed from the BFS package.

Now referring to FIGS. 1A-1C, shown in FIGS. 1A and 1B are a front and side view of a BFS package 10 formed in accordance with an embodiment of the present invention. The BFS package 10 comprises a plurality of containers 11 attached to an information panel 12. Container 11 may be a vial or other vessel suitable for use with medicinal products. The BFS package 10 may be formed from polyethylene (PE) or polypropylene (PP), or other materials suitable for the blow-fill-seal process. FIG. 1C shows a container 11 removed from the BFS package 10.

The information panel 12 has information 13 formed or located thereon. The information 13 may comprise a description of the container contents, dosage information related to the container contents, administration instructions related to the container contents, lot numbers, customer logos, usage diagrams and expiration dates related to the container contents. It is further contemplated that other information related to, or associated with the contents of the container 11 may be included in the information 13. The dimensions of the information panel may be limited by the maximum capacity of the fill machine, for example in some machines the container height may be a maximum of about 16.5 cm.

By having the information panel 12 attached to the plurality of containers 11 there is no need to provide information for each of the plurality of containers 11. This means that containers 11 do not need to be embossed. The ability to avoid having to emboss containers 11 ensures that containers 11 remain structurally sound. Not needing to emboss the containers 11 also simplifies the process of manufacturing containers 11. As shown in FIG. 1C, a container 11 may removed from the information panel at the point of use and the information panel 12 remains attached to the remaining container(s) 11 in the package 10 for future use.

Also formed as part of the BFS package are tabs 14 and twist-off tops 15. A twist-off top 15 is a top which can be detached from container body 17 by twisting container body 17 relative to twist-off top 15. As shown in FIGS. 1A-1C, the tabs 14 are integrally formed with the information panel 12. In the embodiment shown in FIGS. 1A-1C the twist-off tops 15 are integrally formed with the tabs 14, however in alternative embodiments the twist-off tops 15 may be removably attached to the tabs 14. Further, in other alternative embodiments the tabs 14 may be removably attached to the information panel 12.

Still referring to FIGS. 1A-1C, the containers 11 are removably attached to the twist-off tops 14. Each container 11 can be separated from its respective twist-off top 15 without detaching twist-off top 15 from package 10 by manipulation of the container 11. An example of this is shown in FIG. 1C.

Additionally formed as part of the BFS package 10 is base tab 16 which is formed during the manufacturing process. Base tab 16 is employed to seal the container 11 after filling.

Figure 2A:
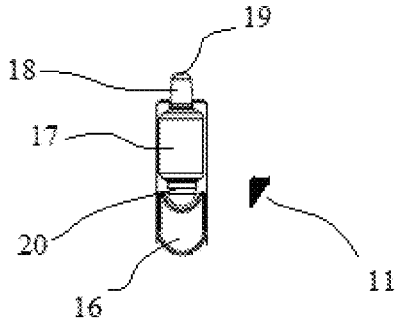
FIG. 2A is a front view of container removed from the BFS package.
Figure 2B:
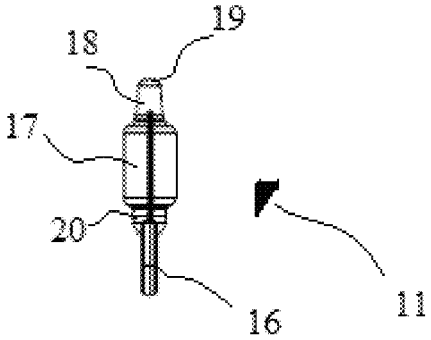
FIG. 2B is a side view of the container shown in FIG. 2A.

FIGS. 2A and 2B show front and side views of a container 11 removed from the twist-off top 15 and BFS package 10 that are shown in FIGS. 1A-1C. Container 11 comprises a container body 17, a top portion 18, an opening 19 and a base portion 20.

Once removed from the BFS package 10 the contents of the container 11 may be dispensed via the opening 19 in the top portion 18. The twist-off top 15, shown in FIGS. 1A-1C is frangibly connected to the top portion 18 when container 11 is still in the package 10. As shown in FIGS. 2A and 2B, top portion 18 may have a conical shape that is tapered in the direction away from container body 17 such that top portion 18 is wider at a location closer to the container body 17 than at another location further from container body 17. The opening 19 in the top portion 18 is revealed when the container 11 is removed from the twist-off top 15 of the BFS package 10, as shown in FIG. 1C. The opening 19 may be circular and in the embodiment shown is adapted and sized for dispensing limited amounts of liquid. It should be understood that the top portion 18 and the opening 19 may vary in shape and size depending on the requirements for dispensing the contents found within the container 11. For example, a conical top portion 18 and circular opening 19 may be appropriate for dispensing individual liquid droplets from container 11. However, it should be understood that other shapes for either or both of top portion 18 and opening 19 are possible depending upon the end use of the BFS package and that the present invention is not limited to use of a particular shape for the top portion 18 or opening 19.

The base portion 20 is securely molded to the container body 17 during the fabrication process. As shown in FIGS. 2A and 2B the base portion 20 is dome-shaped, which corresponds to the shape of the container body 17. Furthermore, in alternative embodiments where the shape of the container 11 may be different than the cylindrical shape shown in the figures, preferably the shape of the base portion 20 will also correspond to the shape of the container body 17 so that the connection between the base portion 20 and container body 17 may be substantially uniform. Having a substantially uniform base portion 20 and container body 17 enables molding of the container body 17 and the base portion 20 in a configuration that is uniform and secure. This prevents leakage or other flaws that may occur during container fabrication.

Figure 3:
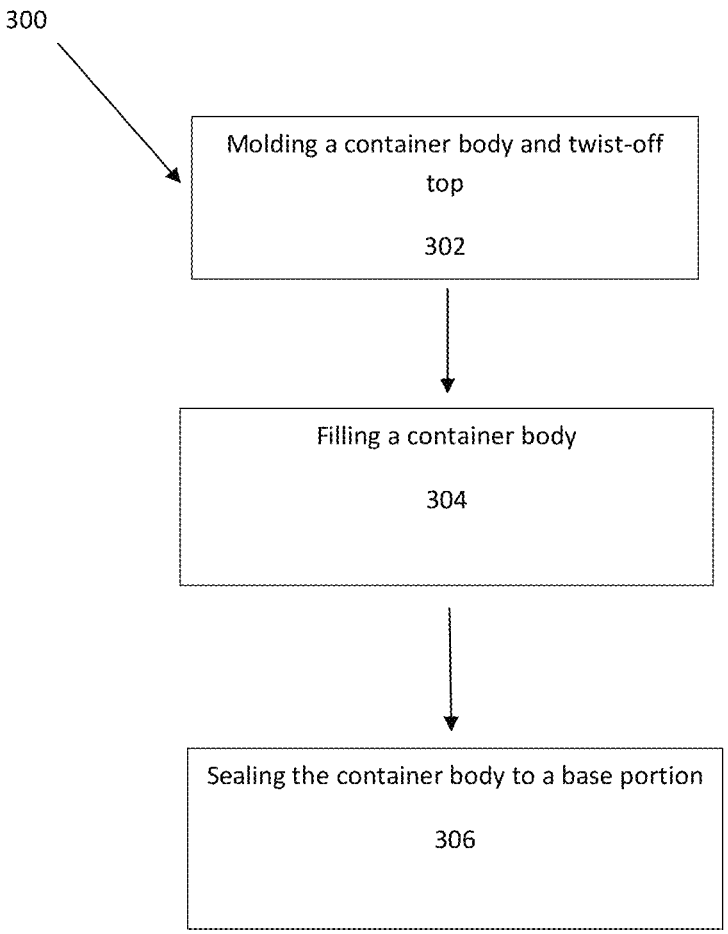
FIG. 3 is a flow chart of a method of forming a BFS package in accordance with an embodiment of the present invention.

Referring to FIG. 3, there is shown is flow chart of a method 300 for forming a BFS package in accordance with an embodiment of the invention. Molding step 302 comprises molding a container body and twist-off top. In the preferred embodiment of the method the container body and the twist off top are molded together with an information panel. Furthermore, during the molding step 302 a plurality of container bodies and twist-off tops may be formed integrally with the information panel. Because the twist-off top and the container body are formed using the main mold for the container, the resulting container is less likely to have defects and/or leaks that might otherwise occur as a result of the complex geometry of the twist-off top and container.

During molding step 302 the material used to form the container body and the twist-off top may be molded at a temperature of from about 135° C. to about 225° C., more preferably, at a temperature of from about 150° C. to about 200° C., and, most preferably, at a temperature of from about 160° C. to about 190° C. The material used in molding step 302 is in a liquid state and thus takes the shape of the mold used in the process.

During the process of formation of the container and twist-off top the portion that is the twist-off top is oriented "up-side" down in comparison to the orientation in which it will ultimately be packaged. Stated otherwise, during the formation process, the container is oriented such that the twist-off top functions as a bottom of the container.

Also during the molding step 302, the information panel may be formed in the main mold so as to be frangibly connected to the twist-off top. The information panel may be formed using an easily removed mold insert that includes information such as, customer information and LOT/EXP (expiration) code pins, and the other information described above. Typically, the BFS molds would need to be removed from the BFS machine to switch engraving inserts for a different product or lot. The quick change design of the present invention incorporates the engraving insert with the code slide insert to eliminate the need to remove the mold from the machine. to switch engraving inserts for a different product or lot. The mold may have a T-slot or dovetail type design in order to retain the insert in the mold during use. This feature of the present design significantly reduces the time required to change the mold for different products or lots, in particular, by eliminating time spent changing code pins for each individual container and obviating the need to remove the molds from the machine to change engraved inserts. Also, this design allows the container to be removed from the information panel at the point of use without removing any information in the process of removing the container from the BFS package. As a result, the required information stays with the remaining containers when one or more container bodies are removed from the BFS package for use.

After molding step 302, the parison held within the mold is permitted to cool, or is cooled, until the molded combination of the container body and twist-off top is sufficiently solid that the container is capable of receiving product.

In filling step 304 the container body formed in step 302 is filled with product. The product used to fill the container body is typically a type of product amenable to being placed in a container, such as biologics, pharmaceuticals and other medicinal products. The product used to fill the container is dispensed at ambient room temperature (i.e. between about 20° C. and about 25° C.). In some instances, the product may be at a temperature below 20° C. and in some instances below 15° C. when it is filled into the container. The product temperature used at the time of filling the container with the product may vary depending on the nature of the product being placed into the container, e.g. either a cold (controlled temperature, below ambient) fill or ambient (no temperature control) fill process may be employed. Typically, with the containers described herein the product used to fill the container is intended for dispensing at ambient room temperature (i.e. between about 20° C. and about 25° C.), however in some instances the product used to fill the container may be dispensed at a temperature below 20° C. and in some instances, at a temperature below 15° C.

By forming the twist-off top in the main mold during molding step 302, a larger opening, formed by the container body, is provided for the fill tube used during the filling step 304. The larger opening creates a more robust sealing interface between the main mold and seal mold, which reduces the risk of producing leaking containers.

In sealing step 306 the container body is sealed to the base portion in a seal mold. During the sealing step 306 the geometry of the base portion used to seal the container body is able to form a more secure and stable seal with the container body than could be formed by the complex geometry of the twist-off tops. During the sealing step 306 the base portion is located distally from the twist-off top and during the molding process the base portion is considered to be located at the top as a result of the orientation of the container during the molding process.

Figure 4:
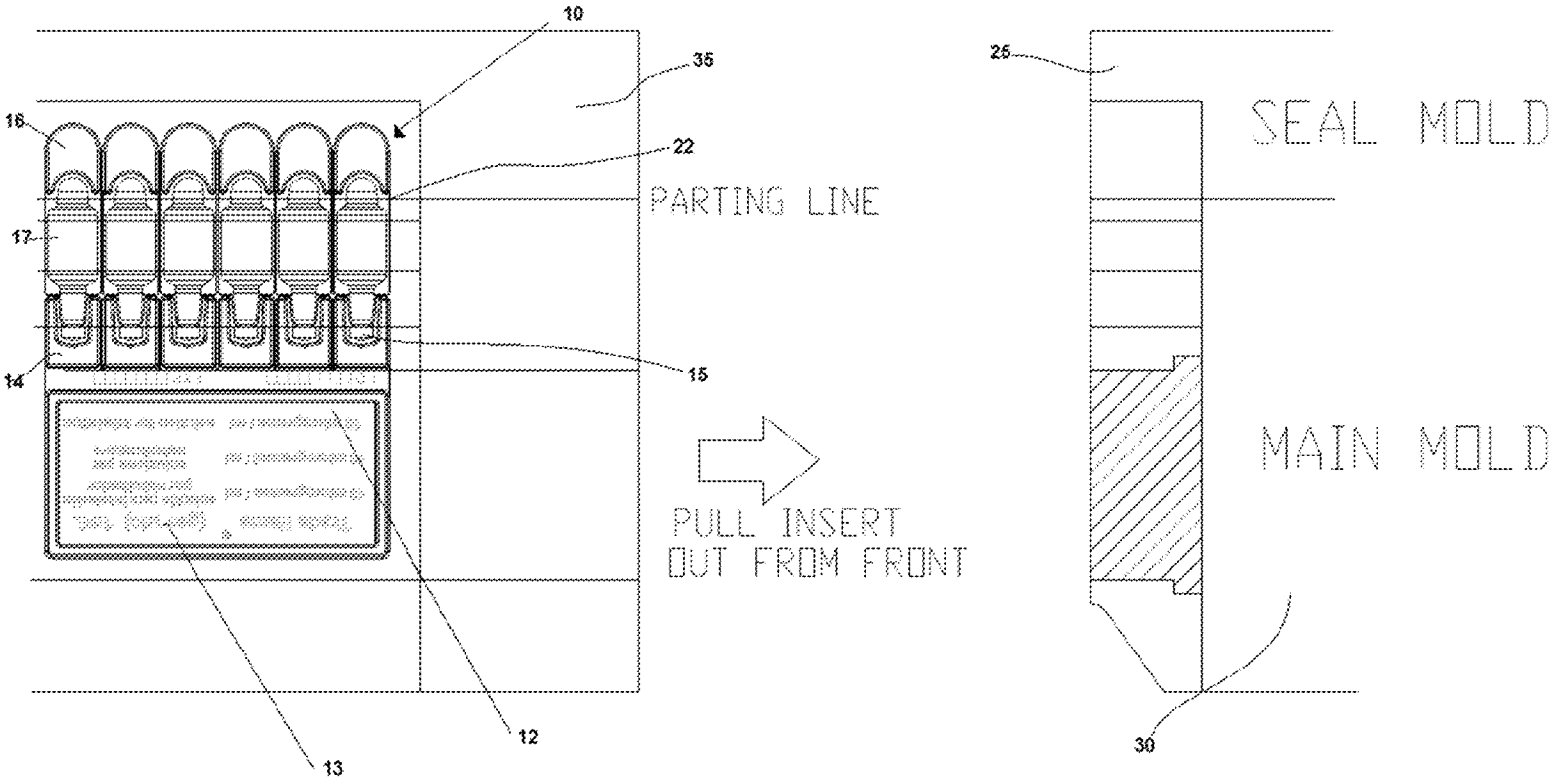
FIG. 4 is a schematic view of BFS package and molding components that can be used to make the BFS package.

FIG. 4 is a diagram showing the BFS package 10 and molding components that may be used in the package formation process, namely, main mold 25 and sealing mold 30. BFS package 10 is located within a mold insert 35. FIG. 4 shows the mold insert 35 withdrawn from the main mold 25 and sealing mold 30 after the formation of the mold insert 35. The main mold 25 is used in forming the information panel 12 with information 13, tabs 14, the twist-off tops 15, and the container bodies 17. Sealing mold 30 is used in forming parting line 22, base tabs 16 and base portions 20 after the container bodies 17 have been filled.

Figure 5:
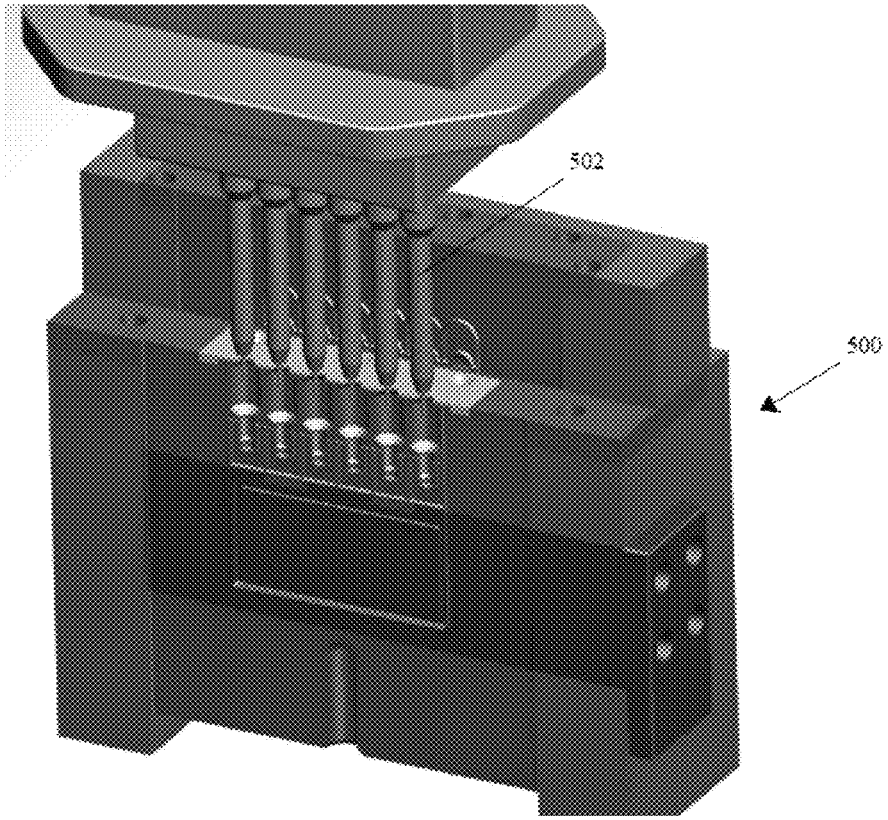
FIG. 5 is a perspective view of a filling machine that may be used in conjunction with the BFS package of the present invention.

FIG. 5 is a perspective view of a filling machine 500 according to an embodiment of the present invention. Fill-tubes 502 are inserted into the openings of container bodies (not shown) in order to fill the containers prior to sealing.

EXAMPLE

In one embodiment, a BFS package may be fabricated in a main mold to provide a container body having a fill opening of about 0.635 cm in diameter. A standard fill/dispensing opening in a conventional BFS package that is adapted for both filling of the container and dispensing the container contents from the same opening may be about 0.477 cm in diameter. The container body may then be filled via the fill opening and then the fill opening is sealed using a base portion fabricated in a sealing mold.

Although the invention has been described using relative terms such as "down," "out," "top," "bottom," "over," "above," "under" and the like in the description and in the claims, such terms are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Unless stated otherwise, terms such as "first" and "second" are used to arbitrarily distinguish between the elements such terms describe. Thus, these terms are not necessarily intended to indicate temporal or other prioritization of such elements. Further, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

It is to be understood, however, that even though numerous characteristics and advantages of the present invention have been set forth in the foregoing description, together with details of the method, composition and function of the invention, the disclosure is illustrative only, and changes may be made in detail, within the principles of the invention to the full extent indicated by the broad general meaning of the terms in which the appended claims are expressed.

Other embodiments of the present disclosure will be apparent to those skilled in the art from consideration of the specification and practice of the embodiments disclosed herein. The foregoing embodiments are susceptible to considerable variation in practice. Accordingly, the embodiments are not intended to be limited to the specific exemplifications set forth hereinabove. It is intended that the specification and examples be considered as exemplary only, with a true scope of the disclosure being indicated by the following claims.

All documents mentioned herein are hereby incorporated by reference in their entirety or alternatively to provide the disclosure for which they were specifically relied upon.

The applicant(s) do not intend to dedicate any disclosed embodiments to the public, and to the extent any disclosed modifications or alterations may not literally fall within the scope of the claims, they are considered to be part hereof under the doctrine of equivalents.

What is claimed is:

1. A method of forming and filling a blow-fill-seal package comprising the steps of:

(a) molding a single information panel, a plurality of container bodies and a plurality of twist-off tops of a blow-fill-seal package in a manner whereby each twist-off top is integrally formed with the information panel and each twist-off top is attached to one said container body in a manner whereby the container body can be removed from the integrally formed twist-off and information panel top by twisting the container body relative to the twist-off top;

(b) filling each container body from step (a) via an opening in the container body; and (c) after step (b), sealing the opening in the container body with a base portion, wherein the blow-fill-seal package is molded such that the twist-off top remains connected to the information panel upon removal of the container body from the blow-fill-seal package.

2. The method of claim 1, wherein the opening in the container body is distal to a location of the twist-off top.

3. The method of claim 1, wherein information is molded into the information panel in said molding step using a mold insert.

4. The method of claim 1, wherein in the molding step at least one of a name, dosage, administration instructions and expiration date for product located in said container bodies are provided to the information panel.

5. The method of claim 1, wherein molding the information panel, container body and the twist-off top is carried out in a main mold.

6. The method of claim 5, further comprising the step of forming the base portion in a sealing mold.

7. The method of claim 1, wherein the information panel comprises lot and expiration data for product located in said container bodies.

8. The method of claim 7, wherein the information panel further comprises dosage data for product located in said container bodies.

* * * * *